US012607016B2

(12) United States Patent
Gross et al.

(10) Patent No.: US 12,607,016 B2
(45) Date of Patent: Apr. 21, 2026

(54) INVERTED FLEECE BACK ASSEMBLIES FOR FLASHING APPLICATIONS

(71) Applicant: Siplast, Inc., Irving, TX (US)

(72) Inventors: Peter Gross, Lancaster, SC (US); Luke Geoffrion, Malvern, AR (US); Tyler Day, Irving, TX (US); Kirk Goodrum, Arkadelphia, AR (US)

(73) Assignee: Siplast, Inc., Irving, TX (US)

( * ) Notice: Subject to any disclaimer, the term of this patent is extended or adjusted under 35 U.S.C. 154(b) by 0 days.

(21) Appl. No.: 19/251,224

(22) Filed: Jun. 26, 2025

(65) Prior Publication Data

US 2026/0002364 A1 Jan. 1, 2026

Related U.S. Application Data

(60) Provisional application No. 63/664,436, filed on Jun. 26, 2024.

(51) Int. Cl.
*E04D 13/16* (2006.01)
*E04D 13/00* (2006.01)

(52) U.S. Cl.
CPC ..... *E04D 13/1681* (2013.01); *E04D 13/006* (2013.01)

(58) Field of Classification Search
CPC ..... E04D 13/006; E04D 13/1681
USPC ..... 52/408
See application file for complete search history.

(56) References Cited

U.S. PATENT DOCUMENTS 4,039,706 A * 8/1977 Tajima ..... E04D 5/10 428/184
4,493,175 A * 1/1985 Coppola, Jr. ..... E04D 5/12 52/410
4,776,904 A * 10/1988 Charlton ..... B32B 27/10 435/805
4,803,111 A * 2/1989 Mansell ..... E04D 11/02 428/137
4,860,514 A * 8/1989 Kelly ..... E04D 5/143 52/410
4,870,796 A * 10/1989 Hart ..... E04D 11/02 52/409
4,996,812 A * 3/1991 Venable ..... E04D 5/143 52/408
5,447,006 A * 9/1995 Zenor ..... E04D 5/149 52/514
6,004,645 A * 12/1999 Hubbard ..... B32B 7/12 52/409

(Continued)

FOREIGN PATENT DOCUMENTS

WO 2023/178190 A1 9/2023

*Primary Examiner* — James M Ference
(74) *Attorney, Agent, or Firm* — GREENBERG TRAURIG, LLP

(57) ABSTRACT

Roofing systems are provided. A roofing system comprises a roofing substrate. The roofing system comprises a first roofing membrane adhered to the roofing substrate. The roofing system comprises a second roofing membrane. The second roofing membrane comprises a first layer and a fleece layer. The first layer of the second roofing membrane is located between the fleece layer and the first roofing membrane. The roofing system comprises a liquid applied flashing located on the fleece layer of the second roofing membrane. Related methods are also provided.

17 Claims, 3 Drawing Sheets

(56) References Cited

U.S. PATENT DOCUMENTS 6,006,482 A * 12/1999 Kelly ..... E04D 13/17 52/409
6,055,786 A * 5/2000 Hubbard ..... G01K 3/00 52/409
6,586,080 B1 * 7/2003 Heifetz ..... B29C 66/72343 428/317.1
6,656,557 B2 * 12/2003 Phillips ..... B32B 11/04 428/351
8,701,367 B2 4/2014 Georgeau et al.
8,959,861 B1 * 2/2015 Wambaugh ..... E04F 13/0898 52/409
10,988,933 B2 4/2021 Reynolds et al.
11,097,311 B2 * 8/2021 Yang ..... E04D 7/00
12,202,228 B2 1/2025 Geoffrion et al.
12,215,500 B2 2/2025 Goodrum
2001/0034984 A1 * 11/2001 Murphy ..... E06B 1/62 52/204.5
2002/0170254 A1 * 11/2002 Ritland ..... E04D 5/12 52/409
2003/0054127 A1 * 3/2003 Heifetz ..... E04B 1/665 428/40.1
2003/0145546 A1 * 8/2003 Georgeau ..... E04D 5/12 52/746.11
2003/0219564 A1 * 11/2003 Hubbard ..... E04D 11/02 428/40.1
2004/0107662 A1 6/2004 Georgeau et al.
2004/0244315 A1 * 12/2004 Rust ..... E04D 3/38 52/198
2005/0022845 A1 * 2/2005 Inagaki ..... B08B 3/00 257/E21.228
2005/0183387 A1 * 8/2005 Durning ..... B32B 13/04 52/782.1
2006/0046084 A1 * 3/2006 Yang ..... E04D 5/10 525/240
2007/0187017 A1 * 8/2007 Hubbard ..... B32B 27/12 156/60
2008/0179574 A1 * 7/2008 Yang ..... C08J 5/2231 524/80
2008/0217947 A1 * 9/2008 Merryman ..... E04D 5/10 296/39.1
2011/0000159 A1 * 1/2011 Ben-Daat ..... B32B 5/022 156/324
2011/0311797 A1 * 12/2011 Worthen ..... B32B 27/12 156/60
2013/0000237 A1 * 1/2013 Kraus, Jr. ..... E04D 13/1643 52/410
2014/0154449 A1 * 6/2014 Peng ..... E04D 5/06 428/41.3
2014/0205789 A1 * 7/2014 Zhou ..... B32B 5/026 428/221
2014/0259972 A1 * 9/2014 Feuer ..... E04D 7/00 52/309.1
2016/0160515 A1 * 6/2016 Wallance ..... E04F 10/10 52/745.02
2017/0145697 A1 * 5/2017 Anthony ..... E04D 13/064
2017/0204602 A1 * 7/2017 Collins ..... E04B 1/7046
2019/0242133 A1 * 8/2019 Gish ..... B32B 5/022
2019/0330854 A1 * 10/2019 Reynolds ..... E04D 13/1407
2020/0095768 A1 * 3/2020 Yu ..... B32B 21/045
2020/0299966 A1 * 9/2020 Tang ..... E04D 5/08
2021/0300007 A1 9/2021 Wang et al.
2021/0339279 A1 * 11/2021 Yancey ..... B05D 3/067
2022/0098866 A1 * 3/2022 Yang ..... B32B 27/302
2022/0403660 A1 * 12/2022 Goodrum ..... E04D 5/10
2023/0139071 A1 * 5/2023 Griffin ..... B32B 27/08 442/38
2023/0272618 A1 * 8/2023 Collett, Jr. ..... E04D 5/12 52/408
2023/0295929 A1 * 9/2023 Sandhar ..... B32B 5/18 52/506.01
2024/0262082 A1 * 8/2024 Geoffrion ..... B32B 15/08
2024/0410164 A1 * 12/2024 Geoffrion ..... B29C 65/485

* cited by examiner

INVERTED FLEECE BACK ASSEMBLIES FOR FLASHING APPLICATIONS

CROSS-REFERENCE TO RELATED APPLICATIONS

This application claims priority to and benefit of U.S. Provisional Patent Application No. 63/664,436 filed Jun. 26, 2024 and entitled "INVERTED FLEECE BACK TPO ASSEMBLY FOR FLASHING PENETRATIONS," the entirety of which is herein incorporated by reference.

FIELD

The present disclosure relates to inverted fleece back assemblies for flashing applications, and related systems and related methods.

BACKGROUND

Roofing accessories are employed in roofing systems to prevent water infiltration into underlying structures.

SUMMARY

Some embodiments relate to a method. In some embodiments, the method comprises obtaining a first roofing membrane. In some embodiments, the first roofing membrane comprises a first surface and a second surface opposite the first surface. In some embodiments, the method comprises obtaining a second roofing membrane. In some embodiments, the second roofing membrane comprises a first surface and a second surface opposite the first surface. In some embodiments, the method comprises securing the second surface of the first roofing membrane to a roofing substrate. In some embodiments, the method comprises welding the first surface of the second roofing membrane to the first surface of the first roofing membrane. In some embodiments, the method comprises applying a coating to the second surface of the second roofing membrane to form a liquid applied flashing on the second roofing membrane.

In some embodiments, the second roofing membrane comprises a first layer. In some embodiments, the first layer comprises the first surface of the second roofing membrane. In some embodiments, the second roofing membrane comprises a fleece layer. In some embodiments, the fleece layer comprises the second surface of the second roofing membrane.

In some embodiments, the first layer comprises at least one of a thermoplastic polyolefin (TPO), a polyvinyl chloride (PVC), a silicone, an ethylene propylene diene monomer (EPDM), or any combination thereof.

In some embodiments, the fleece layer comprises a polyester.

In some embodiments, the first layer directly contacts the fleece layer.

In some embodiments, the first layer is embedded in the fleece layer.

In some embodiments, the second roofing membrane further comprises a reinforcement layer. In some embodiments, the second roofing membrane further comprises a second layer. In some embodiments, the reinforcement layer is located between the first layer and the second layer. In some embodiments, the second layer is located between the reinforcement layer and the fleece layer.

In some embodiments, the first roofing membrane comprises at least one of a thermoplastic polyolefin (TPO), a polyvinyl chloride (PVC), a silicone, an ethylene propylene diene monomer (EPDM), or any combination thereof.

In some embodiments, the coating comprises at least one of an acrylic, a polyurethane, a silyl-terminated polymer, or any combination thereof.

In some embodiments, a peel strength of the liquid applied flashing to the first roofing membrane is 2 PLI to 15 PLI, when measured according to ASTM D1876.

Some embodiments relate to a system. In some embodiments, the system comprises a roofing substrate. In some embodiments, the system comprises a first roofing membrane. In some embodiments, the first roofing membrane is adhered to the roofing substrate. In some embodiments, the system comprises a second roofing membrane. In some embodiments, the second roofing membrane comprises a first layer. In some embodiments, the second roofing membrane comprises a fleece layer. In some embodiments, the first layer is located between the fleece layer and the first roofing membrane. In some embodiments, the system comprises a liquid applied flashing located on the fleece layer of the second roofing membrane.

In some embodiments, the first layer comprises at least one of a thermoplastic polyolefin (TPO), a polyvinyl chloride (PVC), a silicone, an ethylene propylene diene monomer (EPDM), or any combination thereof.

In some embodiments, the fleece layer comprises a polyester.

In some embodiments, the first layer directly contacts the fleece layer.

In some embodiments, the first layer is embedded in the fleece layer.

In some embodiments, the second roofing membrane further comprises a reinforcement layer. In some embodiments, the second roofing membrane further comprises a second layer. In some embodiments, the reinforcement layer is located between the first layer and the second layer. In some embodiments, the second layer is located between the reinforcement layer and the fleece layer.

In some embodiments, the first roofing membrane comprises at least one of a thermoplastic polyolefin (TPO), a polyvinyl chloride (PVC), a silicone, an ethylene propylene diene monomer (EPDM), or any combination thereof.

In some embodiments, the liquid applied flashing comprises at least one of an acrylic, a polyurethane, a silyl-terminated polymer, or any combination thereof.

In some embodiments, a peel strength of the liquid applied flashing to the first roofing membrane is 2 PLI to 15 PLI, when measured according to ASTM D1876.

In some embodiments, the second roofing membrane is welded to the first roofing membrane.

DETAILED DESCRIPTION

Some embodiments relate to coatings that can be applied to low surface energy substrates. Whereas conventional coatings have difficulty, or do not, adhere to substrates with low surface energies, coatings, such as, for example and without limitation, liquid applied flashings are provided herein that are capable of achieving sufficient adhesion to these substrates, among others. In some embodiments, the systems and methods provided herein allow liquid applied flashings to be applied to low surface energy substrates. In some embodiments, the systems and methods utilize a fleece back membrane. In some embodiments, the fleece back membrane is inverted. For example, in some embodiments, the fleece back membrane is installed upside down where the fleece back is the uppermost side, whereas, when a fleece back membrane is typically installed, the fleece back is the lowermost side. In some embodiments, the fleece back membrane is weldable to a low surface energy substrate. In some embodiments, when the fleece back membrane is welded to a low surface energy substrate, a liquid applied flashing is applied to the fleece back of the fleece back membrane. In some embodiments, the fleece back membrane achieves improved adhesion between the low surface energy substrate and the liquid applied flashing.

Figure 1:
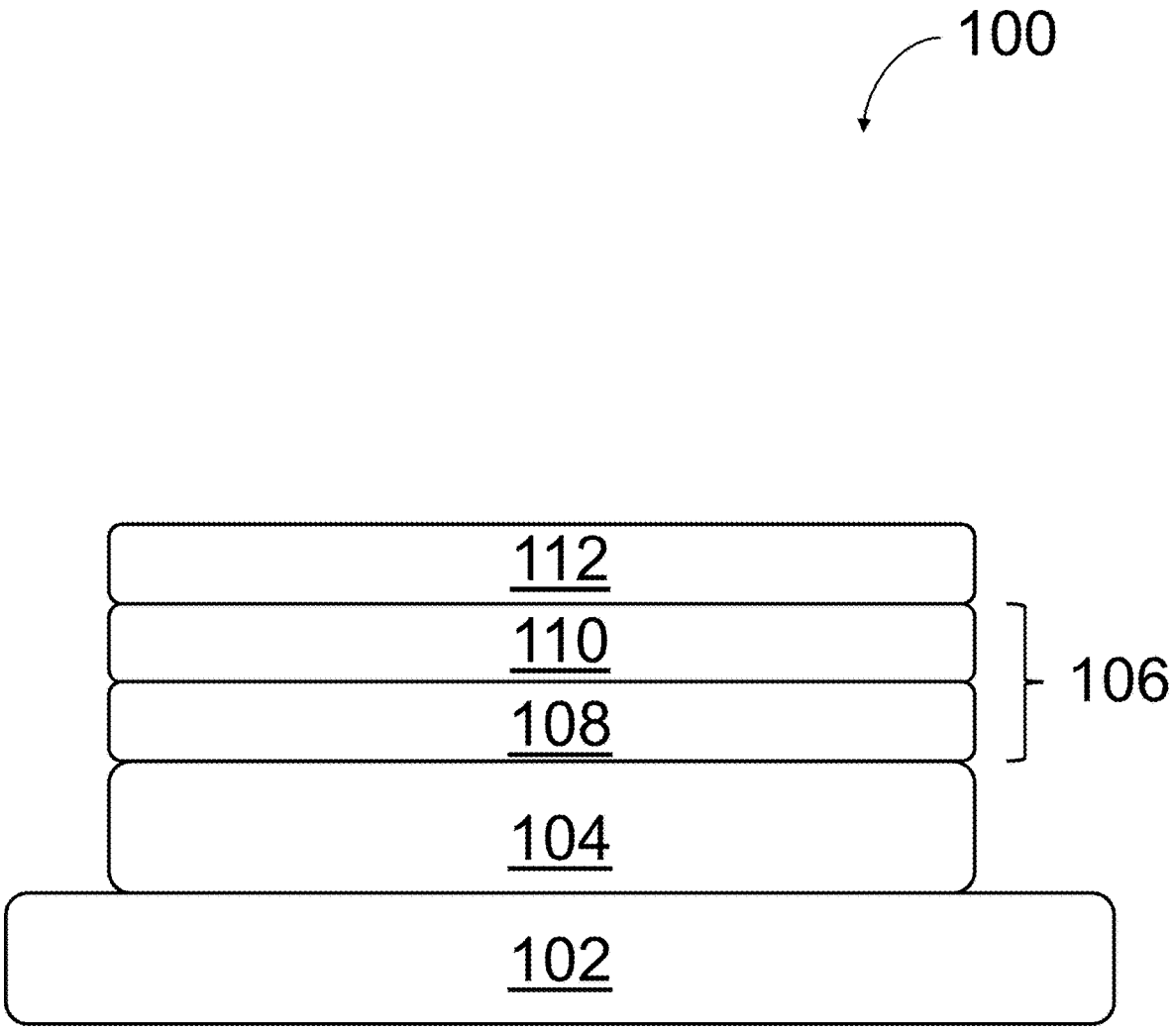
FIG. 1 is a schematic diagram of a cross-section of a roofing system, according to some embodiments.

Some embodiments relate to a system. FIG. 1 is a schematic diagram of a cross-section of a roofing system 100, according to some embodiments. In some embodiments, the roofing system 100 comprises a roofing substrate 102, a first membrane 104, a second roofing membrane 106, and a liquid applied flashing 112.

In some embodiments, the roofing system 100 comprises a roofing substrate 102. In some embodiments, the roofing substrate 102 comprises at least one of an asphaltic substrate, a plywood substrate, a glass substrate, a cellulosic substrate, an underlayment, a roofing membrane (reinforced or unreinforced), a roof deck, a photovoltaic (PV) panel, a modified bitumen (MODBIT) material, an oriented strand board (OSB), a roll good, a board (such as but not limited to at least one of a foam board (e.g., a polyisocyanurate (ISO) foam board), a cover board, or any combination thereof), a fire retardant board, a hail resistant board, a high density cover board, a cement board, concrete, a base sheet, a pipe, a chimney, a wax paper, a roof shingle, a mat, a fabric, a glass mat, a fiberglass mat, a woven mat, a nonwoven a fabric, a polyester mat, a scrim, a coated scrim, or any combination thereof. In some embodiments, the roofing substrate comprises a roof penetration.

In some embodiments, the roofing system 100 comprises a first roofing membrane 104 located on the roofing substrate 102. In some embodiments, the first roofing membrane 104 has a first surface and a second surface opposite the first surface. In some embodiments, the first roofing membrane 104 contacts the roofing substrate 102. In some embodiments, the first roofing membrane 104 directly contacts the roofing substrate 102. In some embodiments, the first roofing membrane 104 is adhered to the roofing substrate 102. In some embodiments, the first roofing membrane 104 is adhered to the roofing substrate 102 by an adhesive. In some embodiments, the first roofing membrane 104 is welded to the roofing substrate 102. As used herein, the term "welded" refers to a process by which two materials, such as a roofing membrane, a roofing substrate, or any combination thereof, are adhered to each other by softening or melting at least a portion of at least one of the two materials and contacting the two materials to fuse them together at least at the softened or melted portion. In some embodiments, the first roofing membrane 104 is heat welded to the roofing substrate 102.

In some embodiments, the first roofing membrane 104 comprises at least one of a thermoplastic polyolefin (TPO), a polyvinyl chloride (PVC), a silicone, an ethylene propylene diene monomer (EPDM), or any combination thereof. In some embodiments, the first surface of the first roofing membrane 104 has a surface energy of 40 mN/m or less. For example, in some embodiments, the first surface of the first roofing membrane 104 has a surface energy of 1 mN/m to 40 mN/m, for example, 1, 5, 10, 15, 20, 25, 30, 35, or 40 mN/m, including ranges between any of the foregoing values.

In some embodiments, the roofing system 100 comprises a second roofing membrane 106. In some embodiments, the second roofing membrane 106 comprises a first layer 108 and a fleece layer 110. In some embodiments, the first layer 108 contacts the fleece layer. In some embodiments, the first layer 108 directly contacts the fleece layer 110. In some embodiments, the second roofing membrane 106 does not comprise an adhesive. In some embodiments, the first layer 108 is located between the first roofing membrane 104 and the fleece layer 110. In some embodiments, the first layer 108 directly contacts the first roofing membrane 104. In some embodiments, the first layer 108 is welded to the first roofing membrane 104. In some embodiments, the second roofing membrane 106 is welded to the first roofing membrane 104. In some embodiments, the roofing system 100 does not comprises an adhesive between the first roofing membrane 104 and the second roofing membrane 106.

In some embodiments, the fleece layer 110 covers at least 50%, at least 60%, at least 70%, at least 80%, at least 90%, or at least 95% of the first layer 108. In some embodiments, the fleece layer 110 covers 50% to 100%, for example, 50, 55, 60, 65, 70, 75, 80, 85, 90, 95, or 100%, including ranges between any of the foregoing values, of the first layer 108. In some embodiments, the fleece layer 110 covers the entirety of the first layer 108.

In some embodiments, the first layer 108 is embedded in the fleece layer 110. In some embodiments, 1% to 100%, for example, 1, 5, 10, 15, 20, 25, 30, 35, 40, 50, 60, 70, 80, 90, 95, or 100%, including ranges between any of the foregoing values, of the first layer 108 is embedded in the fleece layer 110.

In some embodiments, the first layer 108 comprises at least one of a thermoplastic polyolefin (TPO), a polyvinyl chloride (PVC), a silicone, an ethylene propylene diene monomer (EPDM), or any combination thereof.

In some embodiments, the first layer 108 has thickness of 1 mil to 200 mils, for example, 1, 10, 20, 30, 40, 50, 60, 70, 80, 90, 100, 110, 120, 130, 140, 150, 160, 170, 180, 190, or 200 mils, including ranges between any of the foregoing values.

In some embodiments, the fleece layer 110 comprises a polyester. In some embodiments, the fleece layer 110 comprises a polyester fleece. In some embodiments, the fleece layer 110 has a thickness of 1 mil to 200 mils, for example, 1, 10, 20, 30, 40, 50, 60, 70, 80, 90, 100, 110, 120, 130, 140, 150, 160, 170, 180, 190, or 200 mils, including ranges between any of the foregoing values.

Figure 1A:
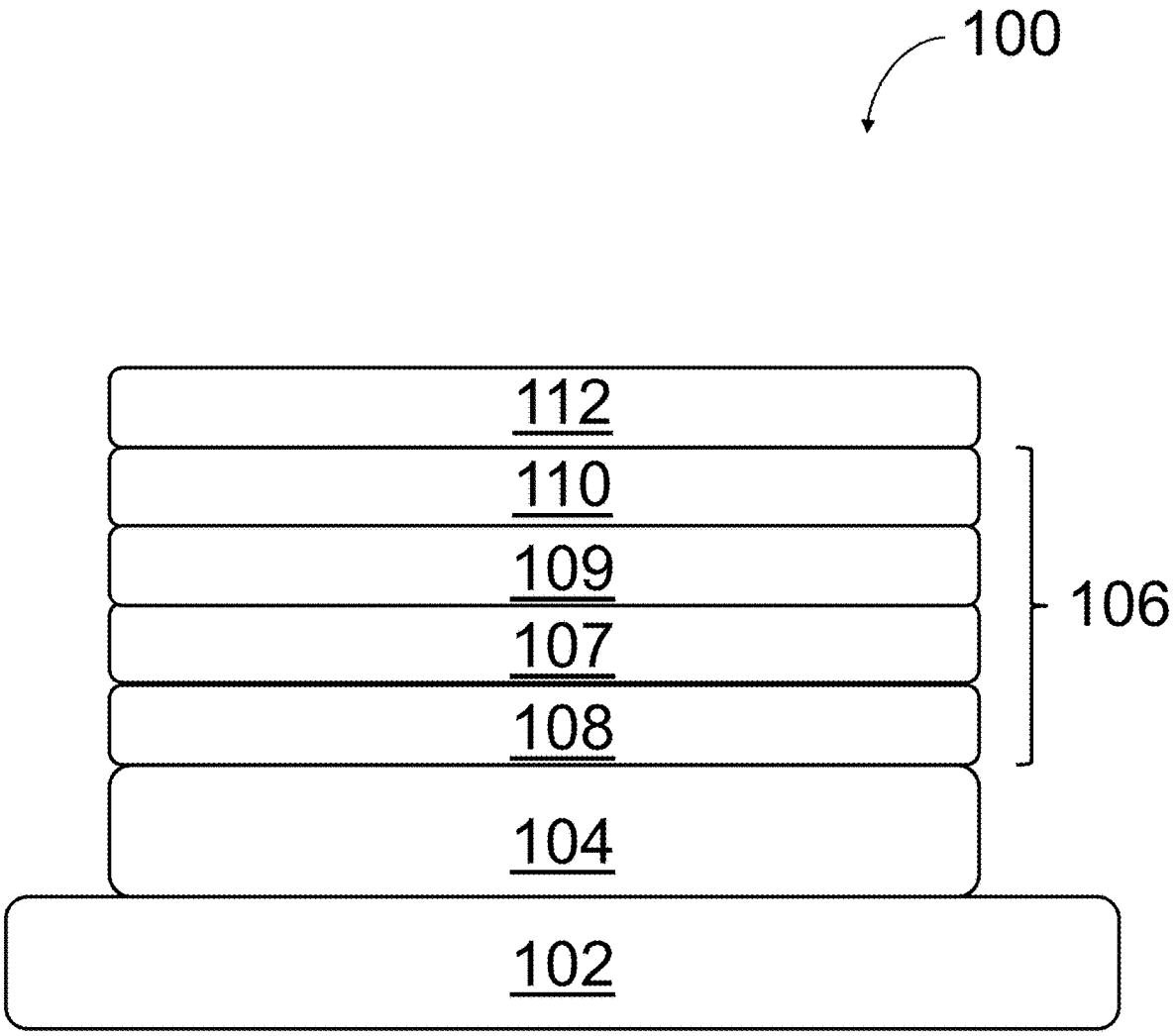
FIG. 1A is a schematic diagram of a cross-section of a roofing system, according to some embodiments.

In some embodiments, as shown in FIG. 1A, the second roofing membrane 106 further comprises a reinforcement layer 106 and a second layer 107. In some embodiments, the reinforcement layer 106 is located between the first layer 108 and the second layer 107. In some embodiments, the second layer 107 is located between the reinforcement layer 106 and the fleece layer 110. In some embodiments, the reinforcement layer 106 contacts the first layer 108. In some embodiments, the reinforcement layer 106 directly contacts the first layer 108. In some embodiments, the reinforcement layer 106 contacts the second layer 107. In some embodiments, the reinforcement layer 106 directly contacts the second layer 107. In some embodiments, the second layer 107 contacts the fleece layer 110. In some embodiments, the second layer 107 directly contacts the fleece layer 110. In some embodiments, the second layer 107 is embedded in the fleece layer 110. In some embodiments, 1% to 100%, for example, 1, 5, 10, 15, 20, 25, 30, 35, 40, 50, 60, 70, 80, 90, 95, or 100%, including ranges between any of the foregoing values, of the second layer 107 is embedded in the fleece layer 110.

In some embodiments, the second layer 107 comprises at least one of a thermoplastic polyolefin (TPO), a polyvinyl chloride (PVC), a silicone, an ethylene propylene diene monomer (EPDM), or any combination thereof.

In some embodiments, the second layer 107 has thickness of 1 mil to 200 mils, for example, 1, 10, 20, 30, 40, 50, 60, 70, 80, 90, 100, 110, 120, 130, 140, 150, 160, 170, 180, 190, or 200 mils, including ranges between any of the foregoing values.

In some embodiments, the reinforcement layer 106 comprises at least one of a scrim, a woven fabric, a non-woven fabric, a metal foil, a fiberglass mat, a polyester mat, a spunbond mat, or any combination thereof.

In some embodiments, the reinforcement layer 106 has thickness of 1 mil to 200 mils, for example, 1, 10, 20, 30, 40, 50, 60, 70, 80, 90, 100, 110, 120, 130, 140, 150, 160, 170, 180, 190, or 200 mils, including ranges between any of the foregoing values.

In some embodiments, the roofing system 100 comprises a liquid applied flashing 112. In some embodiments, the liquid applied flashing 112 comprises at least a first coating layer. In some embodiments, the liquid applied flashing 112 comprises a first coating layer, a reinforcement, and a second coating layer. In some embodiments, the reinforcement is located between the first coating layer and the second coating layer. In some embodiments, the liquid applied flashing 112 contacts the fleece layer 110 of the second membrane 106. In some embodiments, the liquid applied flashing 112 directly contacts the fleece layer 110 of the second membrane 106. In some embodiments, the first coating layer of the liquid applied flashing 112 contacts the fleece layer 110 of the second membrane 106. In some embodiments, the first coating layer of the liquid applied flashing 112 directly contacts the fleece layer 110 of the second membrane 106. In some embodiments, the first coating layer of the liquid applied flashing 112 is embedded in the fleece layer 110 of the second membrane 106. In some embodiments, 1% to 100%, for example, 1, 5, 10, 15, 20, 25, 30, 35, 40, 50, 60, 70, 80, 90, 95, or 100%, including ranges between any of the foregoing values, of the first coating layer of the liquid applied flashing 112 is embedded in the fleece layer 110 of the second membrane 106. In some embodiments, the roofing system 100 does not comprise an adhesive between the liquid applied flashing 112 and the fleece layer 110 of the second membrane 106. In some embodiments, the roofing system 100 does not comprise an adhesive between the first coat layer of the liquid applied flashing 112 and the fleece layer 110 of the second membrane 106.

In some embodiments, the liquid applied flashing 112 comprises a resin. In some embodiments, the liquid applied flashing 112 comprises a cured resin. In some embodiments, the liquid applied flashing 112 comprises at least one of an acrylic, a polyurethane, a silyl-terminated polymer, or any combination thereof. In some embodiments, the liquid applied flashing 112 comprises a polymethyl methacrylate (PMMA).

In some embodiments, the first coating layer, the second coating layer, or any combination thereof comprises a resin. In some embodiments, the first coating layer, the second coating layer, or any combination thereof comprises a cured resin. In some embodiments, the first coating layer, the second coating layer, or any combination thereof comprises at least one of an acrylic, a polyurethane, a silyl-terminated polymer, or any combination thereof. In some embodiments, the first coating layer, the second coating layer, or any combination thereof comprises a polymethyl methacrylate (PMMA).

In some embodiments, the first coating layer and the second coating layer comprise the same materials. In some embodiments, the first coating layer and the second coating layer comprise different materials.

In some embodiments, the reinforcement comprises at least one of a scrim, a woven fabric, a non-woven fabric, a metal foil, a fiberglass mat, a polyester mat, a spunbond mat, or any combination thereof. In some embodiments, the reinforcement comprises a fleece.

In some embodiments, the liquid applied flashing 112 has thickness of 1 mil to 200 mils, for example, 1, 10, 20, 30, 40, 50, 60, 70, 80, 90, 100, 110, 120, 130, 140, 150, 160, 170, 180, 190, or 200 mils, including ranges between any of the foregoing values.

In some embodiments, a peel strength of the liquid applied flashing to the first roofing membrane is 2 pounds per linear inch (PLI) to 15 PLI, for example, 2, 3, 4, 5, 6, 7, 8, 9, 10, 11, 12, 13, 14, or 15, including ranges between any of the foregoing values, when measured according to ASTM D1876.

Figure 2:
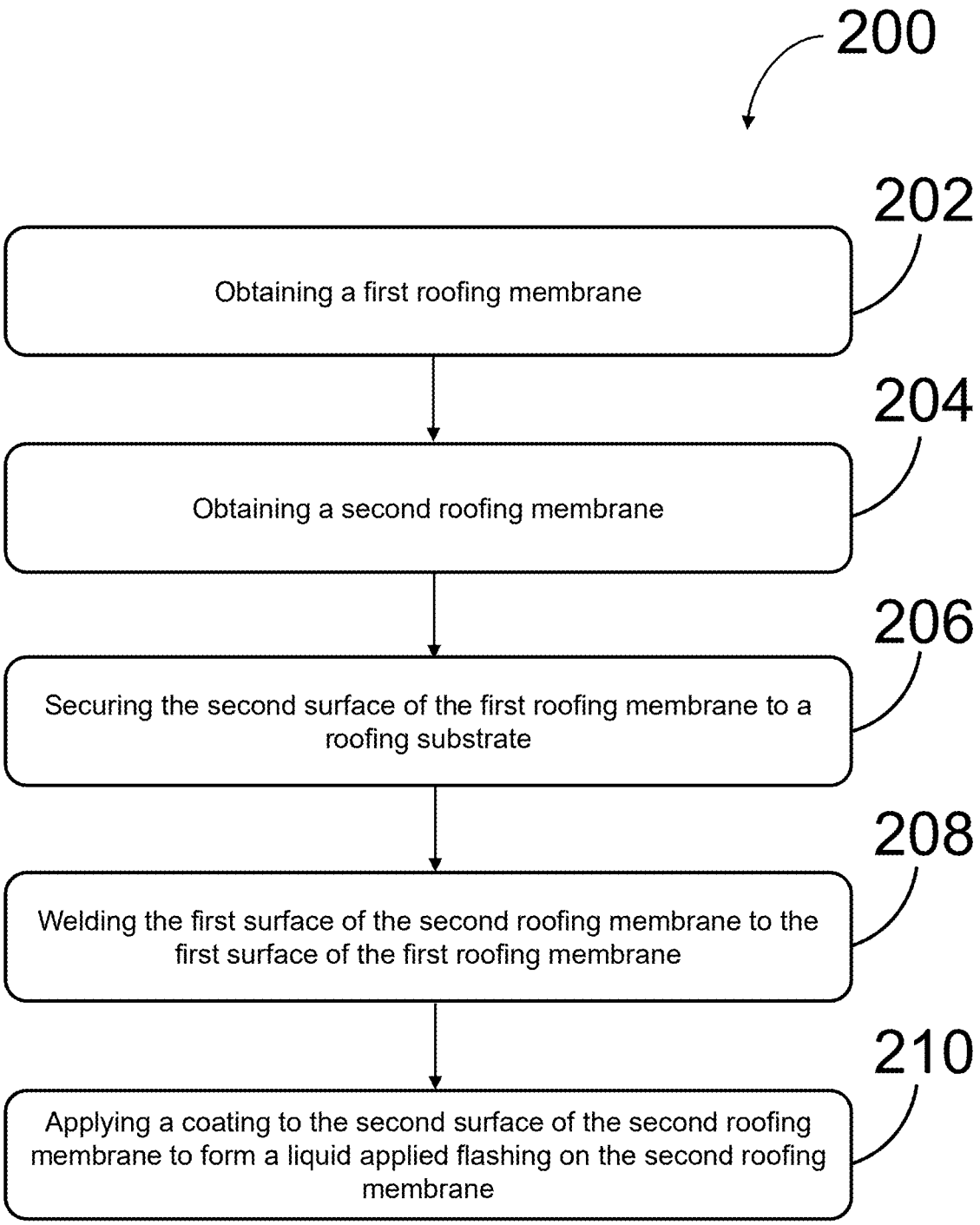
FIG. 2 is a flowchart of a method of installation of a liquid applied flashing to a low surface energy substrate, according to some embodiments.

Some embodiments relate to a method. FIG. 2 is a flowchart of a method 200 of installation of a liquid applied flashing to a low surface energy substrate, according to some embodiments. As shown in FIG. 2, the method 200 of installation may comprise one or more of the following steps: obtaining 202 a first roofing membrane; obtaining 204 a second roofing membrane; securing 206 the second surface of the first roofing membrane to a roofing substrate; welding 208 the first surface of the second roofing membrane to the first surface of the first roofing membrane; and applying 210 a coating to the second surface of the second roofing membrane to form a liquid applied flashing on the second roofing membrane.

At step 202, in some embodiments, the method comprises obtaining a first roofing membrane. In some embodiments, the first roofing membrane has a first surface and a second surface opposite the first surface. In some embodiments, the first roofing membrane can comprise any one or more of the first roofing membranes disclosed herein. For example, in some embodiments, the first roofing membrane comprises at least one of a thermoplastic polyolefin (TPO), a polyvinyl chloride (PVC), a silicone, an ethylene propylene diene monomer (EPDM), or any combination thereof. In some embodiments, the first roofing membrane has a surface energy of 40 mN/m or less. In some embodiments, the first surface of the first roofing membrane has a surface energy of 40 mN/m or less.

At step 204, in some embodiments, the method comprises obtaining a second roofing membrane. In some embodiments, the second roofing membrane has a first surface and a second surface opposite the first surface. In some embodiments, the second roofing membrane comprises any one or more of the second roofing membranes disclosed herein. For example, in some embodiments, the second roofing membrane comprises a first layer and a fleece layer. In some embodiments, the first layer comprises the first surface of the second roofing membrane. In some embodiments, the fleece layer comprises the second surface of the second roofing membrane.

At step 206, in some embodiments, the method comprises securing the second surface of the first roofing membrane to a roofing substrate. In some embodiments, the securing 206 comprises adhering the second surface of the first roofing membrane to a roofing substrate. In some embodiments, the securing 206 comprises adhering the second surface of the first roofing membrane to a roofing substrate by an adhesive. In some embodiments, the securing 206 comprises adhering the second surface of the first roofing membrane to a roofing substrate by heat welding the first roofing membrane to the roofing substrate.

In some embodiments, the roofing substrate comprises any one or more of the roofing substrates disclosed herein.

At step 208, in some embodiments, the method comprises welding the first surface of the second roofing membrane to the first surface of the first roofing membrane. In some embodiments, the welding 208 comprises at least one of heat welding, solvent welding, induction welding, or any combination thereof the first surface of the second roofing membrane to the first surface of the first roofing membrane. In some embodiments, the welding 208 comprises welding the first surface of the second roofing membrane to the first surface of the first roofing membrane such that the first layer of the second roofing membrane is located between the first roofing membrane and the fleece layer of the second roofing membrane.

At step 210, in some embodiments, the method comprises applying a coating to the second surface of the second roofing membrane to form a liquid applied flashing on the second roofing membrane. In some embodiments, the applying 210 comprises at least one of brushing, spraying, pouring, or any combination thereof a coating to the second surface of the second roofing membrane to form a liquid applied flashing on the second roofing membrane. In some embodiments, the applying 210 comprises applying a coating to the fleece layer of the second roofing membrane to form a liquid applied flashing on the second roofing membrane.

In some embodiments, the coating comprises at least one of an acrylic, a polyurethane, a silyl-terminated polymer, or any combination thereof. In some embodiments, the coating comprises a polymethyl methacrylate (PMMA).

In some embodiments, the coating comprises a first coating layer of a liquid applied flashing. In some embodiments, the method further comprises applying a reinforcement to the coating and applying a second coating layer to the reinforcement. In some embodiments, the liquid applied flashing comprises any one or more of the liquid applied flashings disclosed herein.

In some embodiments, the method further comprises curing the coating. In some embodiments, the method further comprises curing the liquid applied flashing.

Any one or more of the embodiments disclosed herein shall be understood to be combinable without departing from the scope or spirit of the disclosure.

Example 1

A liquid applied flashing was applied directly to a first surface of a thermoplastic polyolefin (TPO) membrane and cured. The first surface of the TPO membrane had a surface energy of 40 mN/m or less. The peel strength between the liquid applied flashing and the TPO membrane was measured according to ASTM D1876 to be 0 PLI.

Example 2

A first TPO membrane was obtained. A second TPO membrane comprising a first layer, a reinforcement layer, a second layer, and a fleece layer, wherein the reinforcement layer was located between the first layer and the second layer and wherein the second layer was located between the reinforcement layer and the fleece layer was obtained. The second TPO membrane was heat welded to the first TPO membrane such that the first layer was located between the first TPO membrane and the reinforcement layer and such that the fleece layer was exposed. A liquid applied flashing was applied to the fleece layer of the second roofing membrane and cured. The peel strength between the liquid applied flashing and the first TPO membrane was measured according to ASTM D1876 to be 2 PLI.

Example 3

A first TPO membrane was obtained. A second TPO membrane comprising a first layer and a fleece layer, wherein the first layer directly contacted the fleece layer was obtained. The second TPO membrane was heat welded to the first TPO membrane such that the first layer was located between the first TPO membrane and the fleece layer and such that the fleece layer was exposed. A liquid applied flashing was applied to the fleece layer of the second roofing membrane and cured. The peel strength between the liquid applied flashing and the first TPO membrane was measured according to ASTM D1876 to be 13 PLI.

As can be seen from Example 1, a liquid applied flashing is unable to adhere directly to a substrate having a surface energy of 40 mN/m or less, whereas Examples 2 and 3 show that by utilizing an inverted fleece back membrane, a liquid applied flashing can successfully be adhered to a substrate having a surface energy of 40 mN/m or less.

What is claimed is:

1. A method comprising:
- obtaining a first roofing membrane,
  - wherein the first roofing membrane has a first surface and a second surface opposite the first surface;
- obtaining a second roofing membrane,
  - wherein the second roofing membrane comprises:
    - a first layer;
    - a reinforcement layer;
    - a second layer,
      - wherein the reinforcement layer is located between the first layer and the second layer; and
    - a fleece layer,
      - wherein the second layer is located between the reinforcement layer and the fleece layer:
- securing the second surface of the first roofing membrane to a roofing substrate;
- welding the first layer of the second roofing membrane to the first surface of the first roofing membrane; and
- applying a coating to the fleece layer of the second roofing membrane to form a liquid applied flashing on the second roofing membrane.

2. The method of claim 1, wherein the first layer comprises at least one of a thermoplastic polyolefin (TPO), a polyvinyl chloride (PVC), a silicone, an ethylene propylene diene monomer (EPDM), or any combination thereof.

3. The method of claim 1, wherein the fleece layer comprises a polyester.

4. The method of claim 1, wherein the second layer directly contacts the fleece layer.

5. The method of claim 1, wherein the second layer is embedded in the fleece layer.

6. The method of claim 1, wherein the first roofing membrane comprises at least one of a thermoplastic polyolefin (TPO), a polyvinyl chloride (PVC), a silicone, an ethylene propylene diene monomer (EPDM), or any combination thereof.

7. The method of claim 1, wherein the coating comprises at least one of an acrylic, a polyurethane, a silyl-terminated polymer, or any combination thereof.

8. The method of claim 1, wherein a peel strength of the liquid applied flashing to the second roofing membrane is 2 PLI to 15 PLI, when measured according to ASTM D1876.

9. A system comprising:

a roofing substrate;

a first roofing membrane, wherein the first roofing membrane is adhered to the roofing substrate;

a second roofing membrane, wherein the second roofing membrane comprises:

a first layer;

a reinforcement layer, wherein the first layer is located between first roofing membrane and the reinforcement layer;

a second layer, wherein the reinforcement layer is located between the first layer and the second layer; and a fleece layer, wherein the second layer is located between the reinforcement layer and the fleece layer; and a liquid applied flashing, wherein the liquid applied flashing is located on the fleece layer of the second roofing membrane.

10. The system of claim 9, wherein the first layer comprises at least one of a thermoplastic polyolefin (TPO), a polyvinyl chloride (PVC), a silicone, an ethylene propylene diene monomer (EPDM), or any combination thereof.

11. The system of claim 9, wherein the fleece layer comprises a polyester.

12. The system of claim 9, wherein the second layer directly contacts the fleece layer.

13. The system of claim 9, wherein the second layer is embedded in the fleece layer.

14. The system of claim 9, wherein the first roofing membrane comprises at least one of a thermoplastic polyolefin (TPO), a polyvinyl chloride (PVC), a silicone, an ethylene propylene diene monomer (EPDM), or any combination thereof.

15. The system of claim 9, wherein the liquid applied flashing comprises at least one of an acrylic, a polyurethane, a silyl-terminated polymer, or any combination thereof.

16. The system of claim 9, wherein a peel strength of the liquid applied flashing to the second roofing membrane is 2 PLI to 15 PLI, when measured according to ASTM D1876.

17. The system of claim 9, wherein the second roofing membrane is welded to the first roofing membrane.

* * * * *